US006299004B1

(12) United States Patent
Thalenfeld et al.

(10) Patent No.: US 6,299,004 B1
(45) Date of Patent: Oct. 9, 2001

(54) SHELF ORGANIZING SYSTEM

(75) Inventors: David R. Thalenfeld, Bear Creek, PA (US); Thomas O. Nagel, Blairstown, NJ (US); Richard J. Wildrick, Hunlock Creek, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 09/459,057

(22) Filed: Dec. 10, 1999

(51) Int. Cl.[7] ..... A47F 5/00
(52) U.S. Cl. ..... 211/184; 211/59.4
(58) Field of Search ..... 211/59.2–59.4, 211/51, 184, 90.01; 108/60–61; 40/642.02, 649, 651, 653, 657–658, 647–648, 668–669

(56) References Cited

U.S. PATENT DOCUMENTS

| | | | | |
|---|---|---|---|---|
| 3,308,961 | | 3/1967 | Chesley . | |
| 4,712,694 | * | 12/1987 | Breslow | 211/184 |
| 4,762,236 | * | 8/1988 | Jackle, III et al. | 211/59.3 |
| 4,775,058 | * | 10/1988 | Yatsko | 211/184 |
| 4,830,201 | | 5/1989 | Breslow . | |
| 4,896,779 | * | 1/1990 | Jureckson | 211/184 |
| 5,088,607 | * | 2/1992 | Risafi et al. | 211/59.3 |
| 5,119,945 | * | 6/1992 | Wiggins | 211/59.2 |
| 5,205,421 | | 4/1993 | Bustos . | |
| 5,255,802 | * | 10/1993 | Krinke et al. | 211/184 |
| 5,577,623 | * | 11/1996 | Bustos | 211/59.2 |
| 5,673,801 | * | 10/1997 | Markson | 211/59.3 |
| 5,839,588 | * | 11/1998 | Hawkinson | 211/59.3 |
| 6,006,678 | * | 12/1999 | Merit et al. | 108/60 |
| 6,047,647 | * | 4/2000 | Laraia, Jr. | 108/61 |

* cited by examiner

*Primary Examiner*—Daniel P. Stodola
*Assistant Examiner*—Jennifer E. Novosad
(74) *Attorney, Agent, or Firm*—Schweitzer Cornman Gross & Bondell LLP

(57) ABSTRACT

A shelf organizing system for dividing flat merchandise display shelving. An extruded front rail member typically of generally L-shaped configuration is secured to the front of a shelf, providing a vertical barrier wall. A retention channel, preferably including one or more resilient retention flanges, is formed integrally with the front rail member. Divider elements, extruded in continuous lengths and cut to desired length for particular shelf width, are formed with a vertical flange and a horizontal stabilizing flange. The stabilizing flange is insertable in the retention channel, at any point along its length, and is tightly gripped therein to hold the divider element in any desired position. The divider element may be easily installed by pressing laterally into contact with merchandise to be segregated, and then moving the divider into the retention channel. Divider elements may also be formed advantageously of wire instead of plastic. The system facilitates maintenance of neat shelf displays, which has been proven to increase sales.

15 Claims, 9 Drawing Sheets

FIG. 6
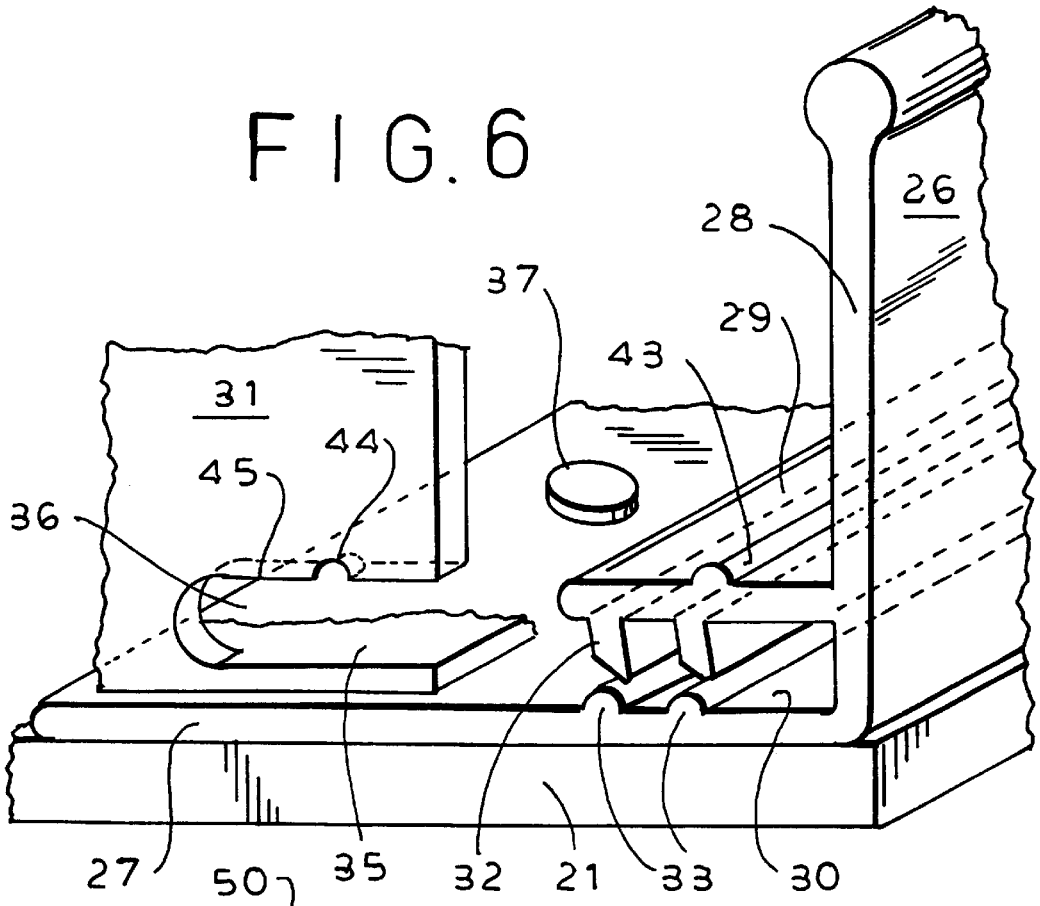
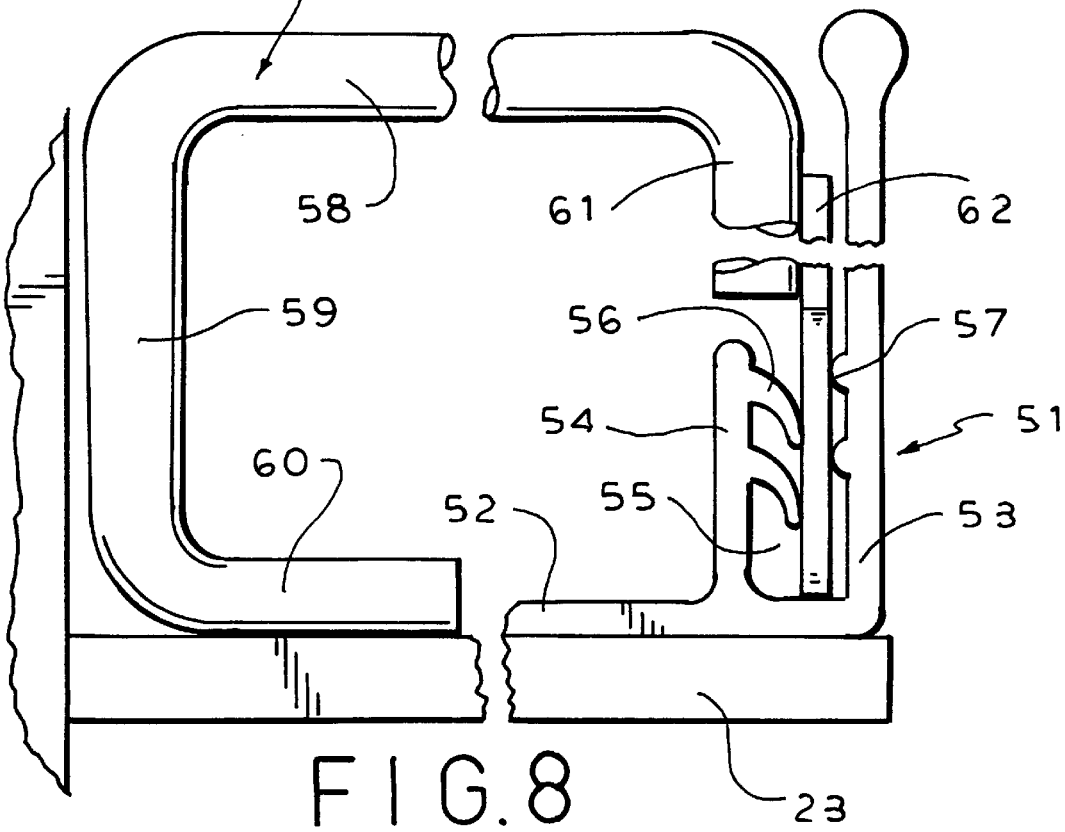
FIG. 8

SHELF ORGANIZING SYSTEM

BACKGROUND AND SUMMARY OF THE INVENTION

The present invention is directed to shelf organizing systems of the type typically used in large retail stores, and more particularly to an improved and economical design and construction of such shelf organizing systems.

Retail stores make extensive use of display shelving, typically in the form of so-called gondolas, which are self-standing units, usually in sections of four feet, provided with means for supporting display shelving at various heights. The individual shelf sections, which usually run the full four foot width of the gondola, may be of various depths, depending upon the requirements of the retailer.

Retailers frequently like to divide the surfaces of the shelf sections to provide front-to-rear confinement of individual products. This provides for a neater appearing display, and also keeps the merchandise properly aligned with the pricing and other information provided at the front of the shelf. It is well established that nicely organized shelves lead to greater sales. Some of the widely used organizing systems involve the use of an extruded plastic front rail, at the front of the shelf, which is associated with molded plastic divider elements, which attach to the front rail and extend rearward. To accommodate shelves of different depths, the plastic dividers typically are molded to the maximum shelf depth, and are provided with break-off sections at suitable increments, e.g., every two inches. For narrow shelves, portions of the molded dividers are broken off to fit. This results in some wastage and extra labor, but the cost of making separate molds for different lengths of shelf dividers is prohibitively high. Moreover, for relatively tall, narrow merchandise it is desirable to provide lateral support to prevent the merchandise from being tipped over accidentally. With molded divider elements, the cost of providing tall dividers suitable for this purpose is extremely high, because of the mold costs.

The present invention provides a shelf management system of exceptional simplicity and economy, in which the divider elements can be extruded in continuous lengths, and then cut to any lengths appropriate to the shelving. By this means, a simple, relatively inexpensive extrusion die is suitable for a shelf divider of given height and configuration, regardless of length.

The system of the present invention also enables the divider elements to be formed inexpensively of wire, which can be especially beneficial when providing for dividers with a substantial height dimension.

In a particularly advantageous form of the invention, an extruded front rail member is provided, which extends along the full width of the shelving. The front rail member is provided with a horizontal base wall which is secured at the front of the shelf, and a vertical wall portion which extends upwardly therefrom and forms a front barrier. A channel-forming wall is associated with one of the base or barrier walls of the front rail member and provides a retention channel for the reception and retention of individual divider elements at any point along the length of the front rail. To particular advantage, one or more elastic retaining flanges is co-extruded internally of the retention channel. The arrangement is such that a portion of a divider element is insertable into the retention channel, against the resistance of the elastic retaining flanges, which then serve to tightly grip and retain the divider element in its assembled position.

To particular advantage, the front rail member can be co-extruded of an opaque, colored plastic in the lower portion and clear, transparent plastic in the upper portion. The opaque lower portion conceals the interior of the retention channel, providing a neater appearing installation the color of the opaque portion can advantageously be matched to the color of the shelving.

In any of its various forms, the shelf management system of the invention is economical to produce, yet easy to assemble and adjust, providing optimum efficiency in shelf management for the retailer.

For a more complete understanding of the above and other features and advantages of the invention, reference should be made to the following detailed description of preferred embodiments of the invention and to the accompanying drawings.

DESCRIPTION OF THE DRAWINGS

FIG. 6 is a fragmentary perspective view similar to FIG. 3, illustrating a modified form of the invention, in which means are provided to help secure the divider elements in position.

FIG. 8 is a further enlarged, fragmentary elevational view of the system of FIG. 7, showing details of the manner in which the wire divider elements are retained in the front rail member.

DESCRIPTION OF PREFERRED EMBODIMENTS

Figure 1:
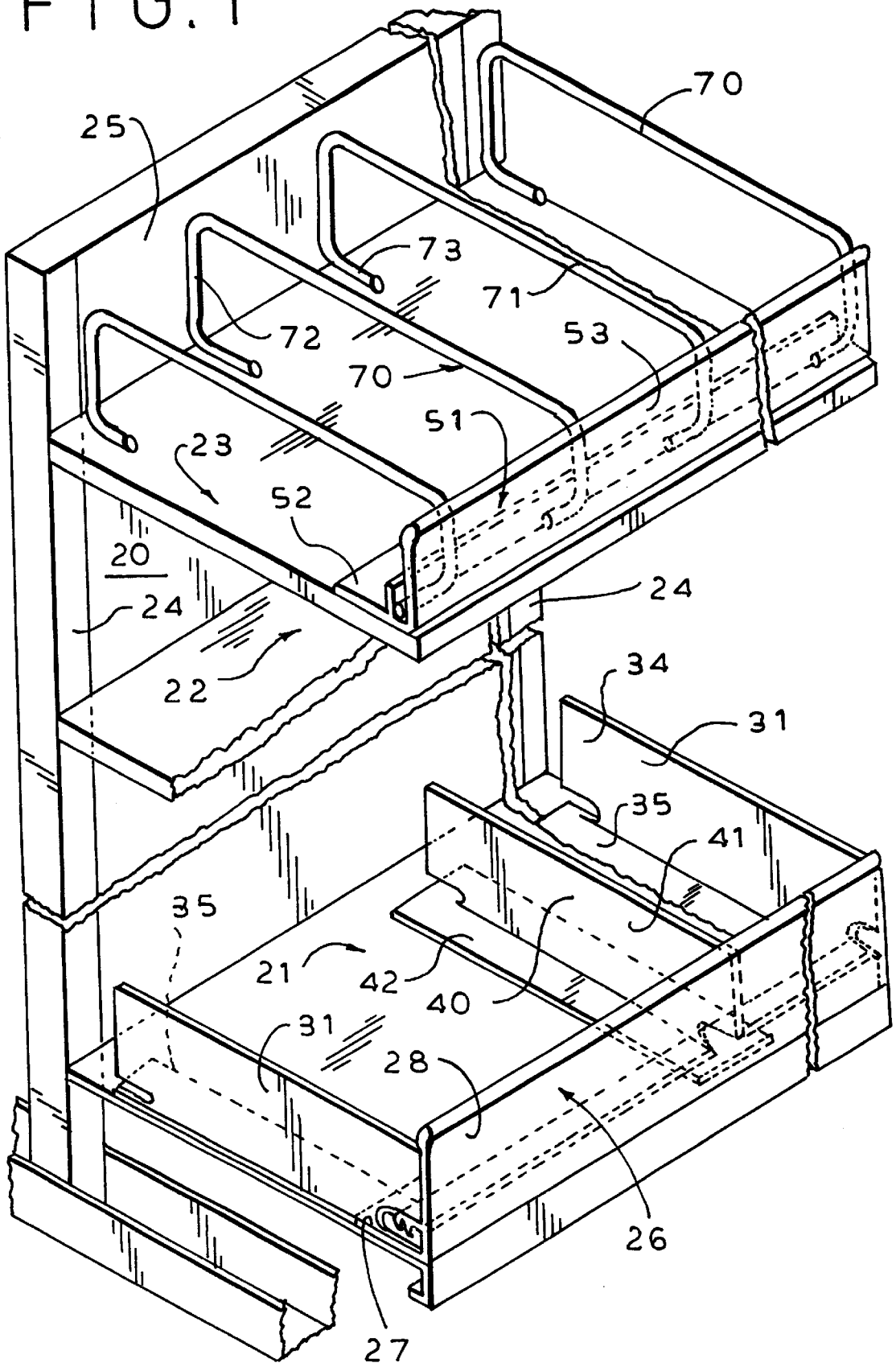
FIG. 1 is a fragmentary front perspective view of a typical shelf gondola, showing two forms of the shelf management system of the invention.

Referring now to the drawings, and initially to FIG. 1 thereof, the reference numeral 20 designates generally a typical gondola shelf structure widely used for the display of merchandise. The gondola structure typically includes a plurality of flat merchandise display shelves 21, 22, 23, adjustably mounted at desired levels by means of vertical rails 24 mounted on a back panel 25.

In accordance with the invention, a front rail member 26 of generally L-shaped cross sectional configuration is mounted at the front of the shelf. Each of the front rail members has a horizontal base wall 27 and a vertical barrier wall 28. The barrier wall is typically located at the front edge extremity of the shelf and serves as a forward barrier for merchandise displayed on the shelf. The rail member advantageously extends along the full length of the shelf, as reflected in FIG. 1.

Figure 2:
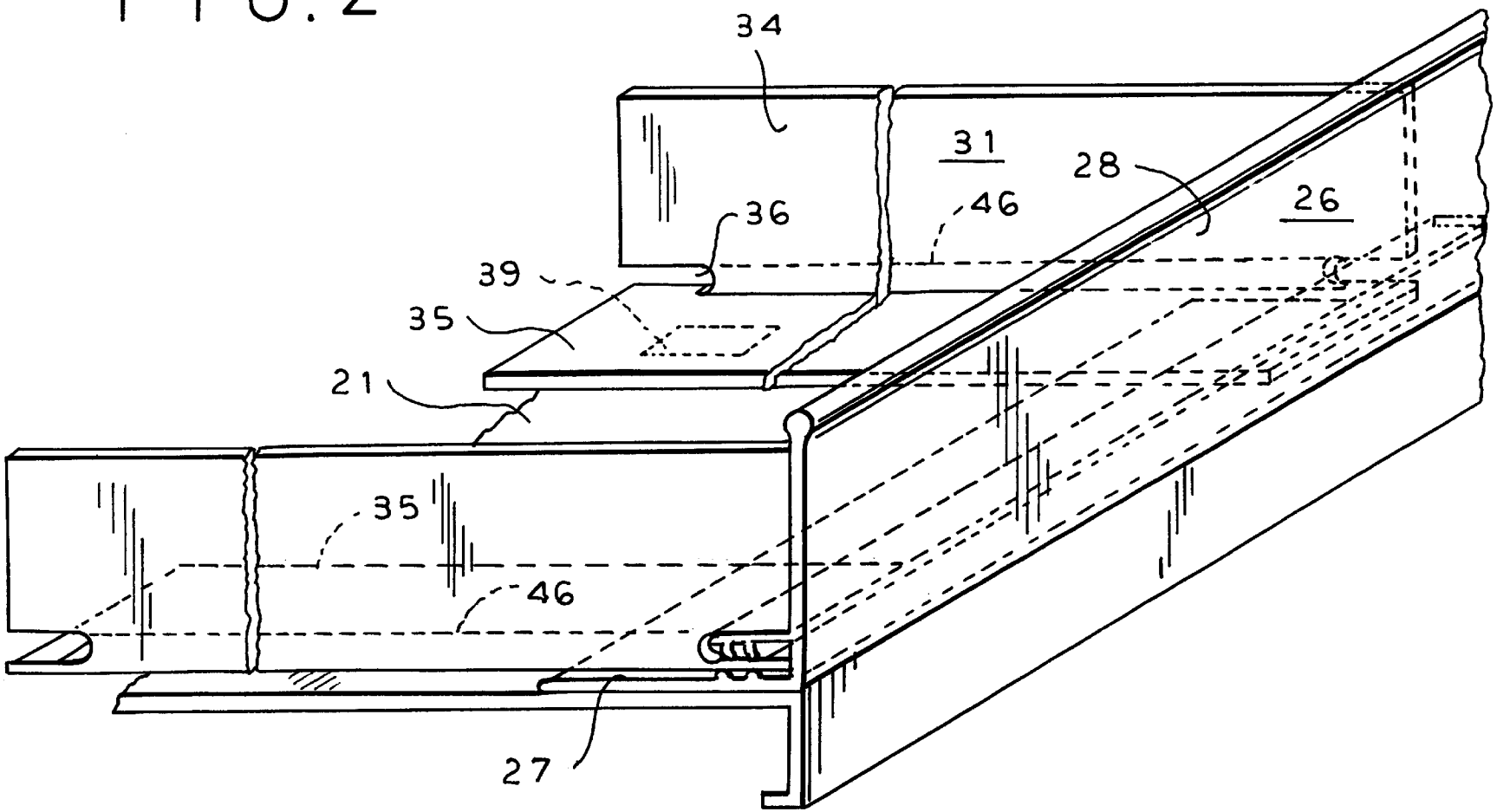
FIG. 2 is an enlarged, fragmentary perspective view showing one advantageous form of the system of the invention, employing extruded plastic divider elements.

In one advantageous form of the invention, shown in use in conjunction with the bottom shelf 21, the front rail member 26 is provided with an integral, rearwardly extending channel-forming wall 29 (see FIGS. 2 and 3) which extends rearwardly from the barrier wall 28, parallel to and spaced a short distance above the base wall 27. The channel-forming wall 29, together with the base wall 27, defines a rearwardly opening retention channel 30 intended for the reception of lateral divider elements 31, to be further described.

To advantage, the retention channel 30 is provided with one or more retaining flanges 32 which project into the retaining channel generally opposite a pair of opposing ribs 33.

The principal walls of the front rail member, that is the base wall 27, the barrier wall 28 and the channel-forming wall 29 are extruded of a rigid plastic material, such as rigid polyvinyl chloride. The retaining flanges 32 and ribs 33 are co-extruded of a softer, resilient plastic material, such as soft polyvinyl chloride.

In a preferred form of the invention, the lower portions of the front rail member 26, including the elements forming the retention channel 30 (i.e., the base wall 27 and the channel-forming wall 29) are formed by an opaque material to conceal the interior of the channel 30 from view. The color of the opaque material can be chosen to be similar to that of the shelving. Upper portions of the barrier wall 28 are formed of a clear, transparent material, which can be polyvinyl chloride but advantageously can be co-extruded of material currently marketed by Eastman Chemical under its trademark "PROVISTA" which has a particularly high level of clarity and transparency.

Figure 3:
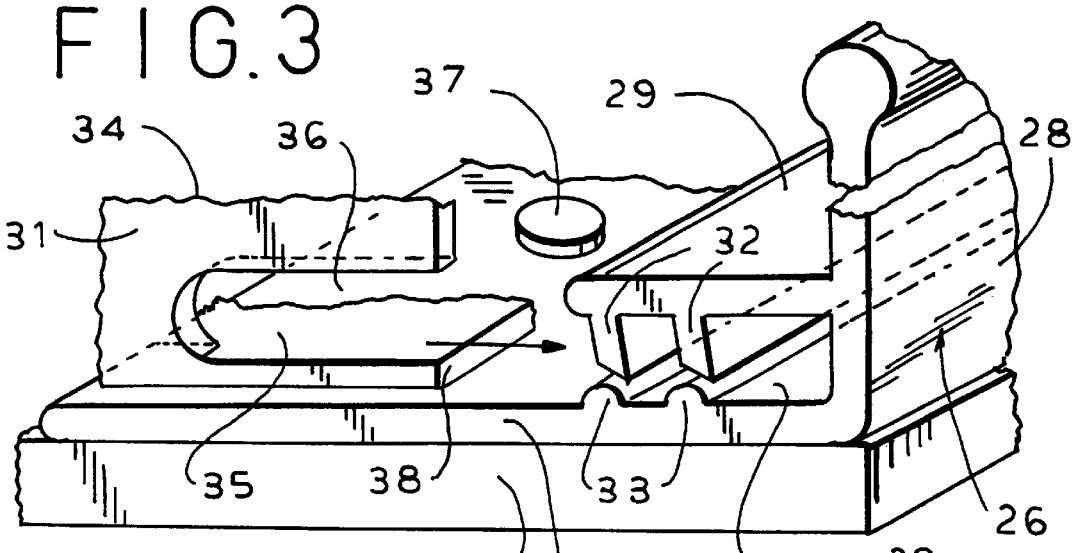
FIG. 3 is a further enlarged, fragmentary illustration of the system of FIG. 2, illustrating a divider element in position to be inserted into the front rail element.
Figure 4:
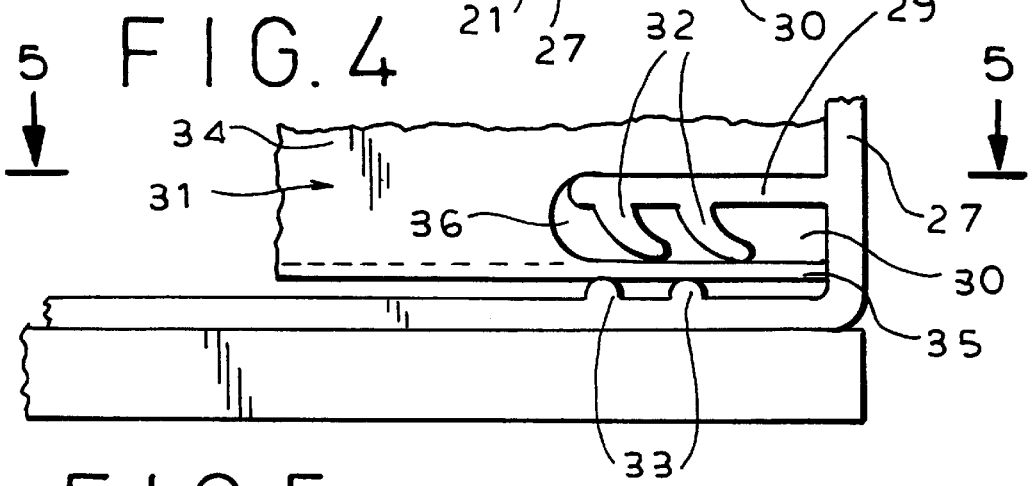
FIG. 4 is a fragmentary end elevational view of the elements of FIG. 3, shown in an installed position.
Figure 5:
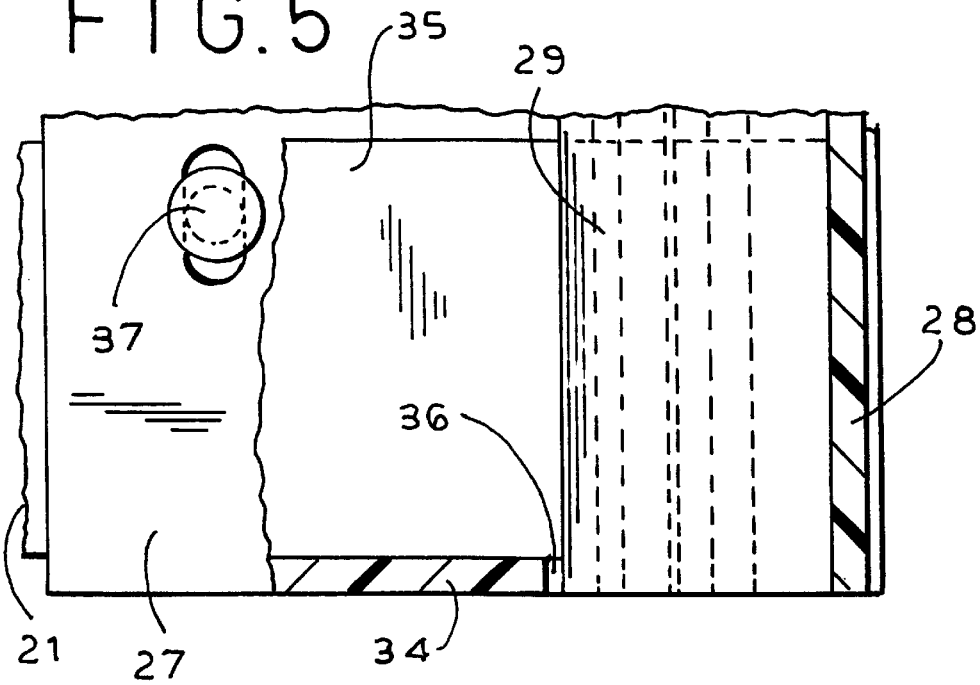
FIG. 5 is a cross sectional view as taken generally on line 5—5 of FIG. 4.

In the arrangement shown in FIGS. 3 and 4, divider elements 31, which are extruded in continuous lengths of a rigid plastic material, such as polyvinyl chloride, are of generally L-shaped configuration, comprising a vertical dividing wall 34, and a horizontal stabilizing wall 35. The individual extruded sections are cut to appropriate length for the width of the shelving and, in conjunction with cutting to length, are provided at one or both ends (preferably both) with a notch 36, opening at the end of the divider section and defined on the lower side thereof by the stabilizing wall 35 of the divider element.

In the normal use of the new divider system, the front rail element 26 is permanently or semi-permanently affixed to the front of the shelf, by means of adhesive or push pins 37, for example. A divider element 31 is moved laterally along the shelf to a desired position and then pushed in a forward direction, such that the forward portion of the stabilizing flange 35 is forced into the retention channel 30. The spacing between the flexible retaining flanges 32 and the opposing ribs 33 is less than the thickness of the stabilizing flange 35, such that these elements are distorted during insertion of the stabilizing flange into the retaining channel, in the manner indicated in FIG. 4. Advantageously, the depth of the notch 36 is such as to allow the forward end 38 of the stabilizing flange to be seated firmly against the barrier wall 28. As shown in FIG. 4, the divider element 31 is thus tightly secured in the retention channel. It has a great deal of stability against accidental lateral tilting, for example, because of the width of the front face 38, which in a typical embodiment, may be on the order of ¾ of an inch. If necessary, the back end of the divider element may be secured by tape 39 (FIG. 2), but normally this is not required.

Of course, the divider element 31 may be removed and repositioned as frequently as desired. Once installed in a desired position, however, it tends to resist accidental dislodgment.

As shown in FIG. 1, modified divider elements 40 may be provided with an inverted T-shaped configuration, in which the vertical dividing wall 41 is centered on a stabilizing wall or flange 42. As also indicated in FIG. 1, by notching the divider elements 31 at both ends, they may be turned end for end where desired, so that the stabilizing flanges 35 (in dividers of L-shaped configuration) can be oriented to extend in either direction. Additionally, where the dividers are notched at both ends, the option is available to insert a barrier rail (not shown) at the back ends of selected dividers, for confinement at the back and/or increased stability of the back ends of the dividers.

In a slightly modified form of the invention shown in FIG. 6, the channel-forming flange 29 of the front rail member 26 is formed with an upwardly projecting rib 43 arranged for cooperation with a small recess 44 formed in the upper wall 45 of the notch 36 provided at the end of the divider element 31. When the divider element is fully inserted into the retention channel 30, in the manner of FIG. 4, the rib 43 engages the recess 44, providing a locking detent action to further resist accidental dislodgment of the divider element.

In any of its embodiments, the extruded divider elements 31 may be co-extruded of an opaque material forming at least the stabilizing flange portions 35, 42, preferably using a color to match that of the shelving. In a typical embodiment, the opaque material may extend upward to form the lower portion of the dividing wall 34, 41, for example up to a level 46 in FIG. 2, approximately at the level of the opaque material of the front rail member 26. Upper portions of the dividing walls may advantageously be formed of an ultra clear material, such as "PROVISTA".

Figure 7:
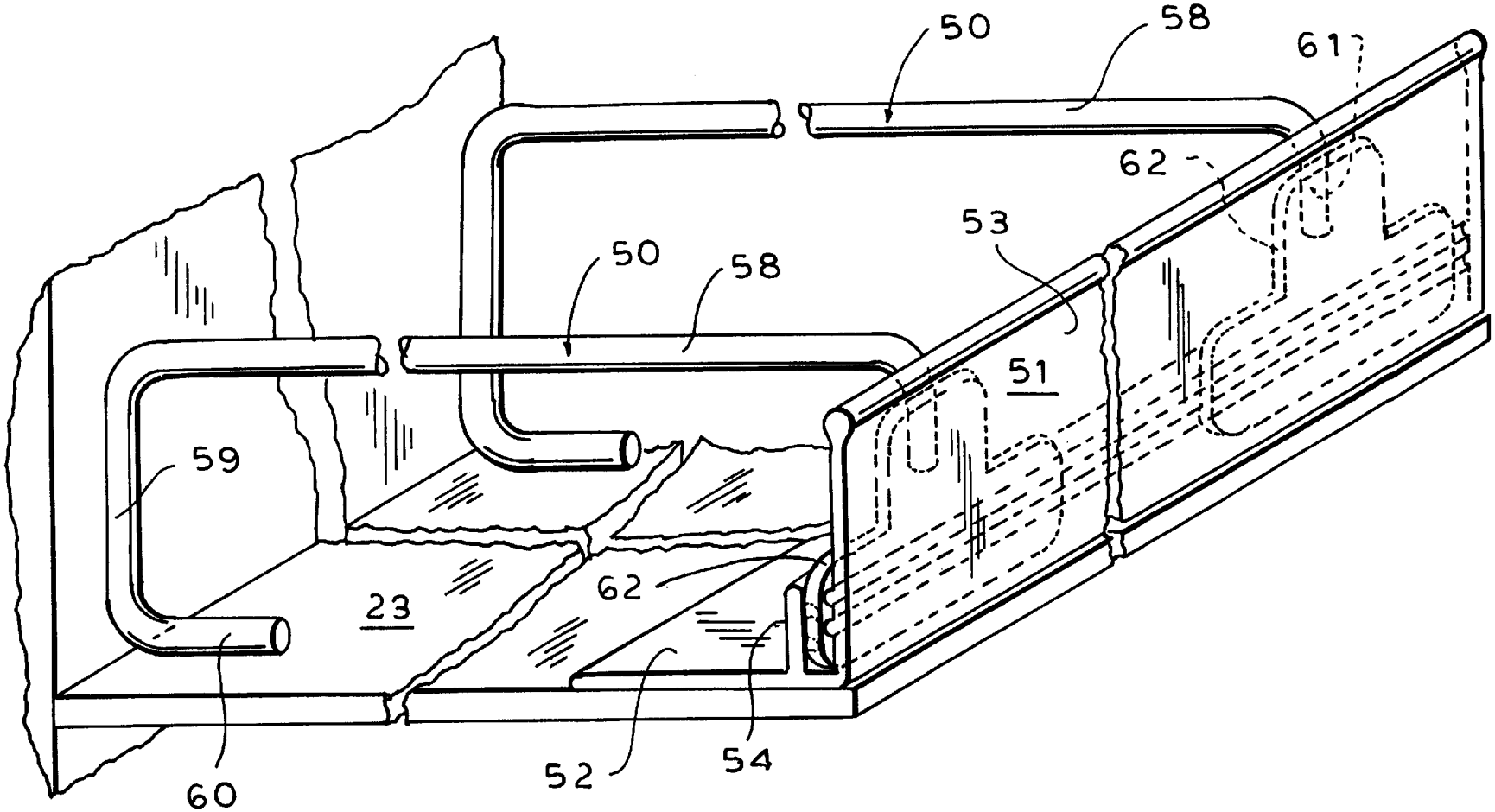
FIG. 7 is an enlarged fragmentary perspective view illustrating a further modified form of the shelf management system, in which the divider elements are formed of wire, provided with retention plates for engagement with the front rail member.

A modified form of the invention is shown in FIGS. 7 and 8, in which divider elements 50 are formed of wire instead of plastic. The use of wire dividers, in place of plastic, may be desirable in some instances, especially where the dividers are used in connection with tall articles of merchandise, such as bottles. Although extruded plastic dividers are far more economical than molded plastic dividers, even extruded dividers can have an undesirable cost factor when the vertical dividing wall is of significantly extended height.

Using wire dividers, the height of the divider is not a significant cost factor.

In the embodiment of FIGS. 7 and 8, an extruded front rail member 51 is formed of rigid plastic, in a generally L-shaped configuration, with a base wall 52 and a vertical barrier wall 53. A channel-forming wall 54 extends vertically from the base wall, in spaced relation to the front or barrier wall 53. The channel-forming wall 54 and the barrier wall 53 define a retention channel 55. As in the previous embodiment, the retention channel, which may be of opaque material, is provided with one or more co-extruded, flexible retaining flanges 56 and opposed ribs 57.

The wire divider element 50 advantageously comprises a rearwardly extending, generally horizontal divider section 58 which joins at the back with a vertical leg 59 and, preferably, a short, forwardly extending support leg 60. At the front end of the divider section 58, is a downwardly extending leg 61 that is welded or otherwise secured to a tongue plate 62, preferably of inverted T-shaped configuration, as seen in FIG. 7. The divider 50 is installed by vertical insertion of the tongue plate 62 into the retention channel 55.

Figure 9:
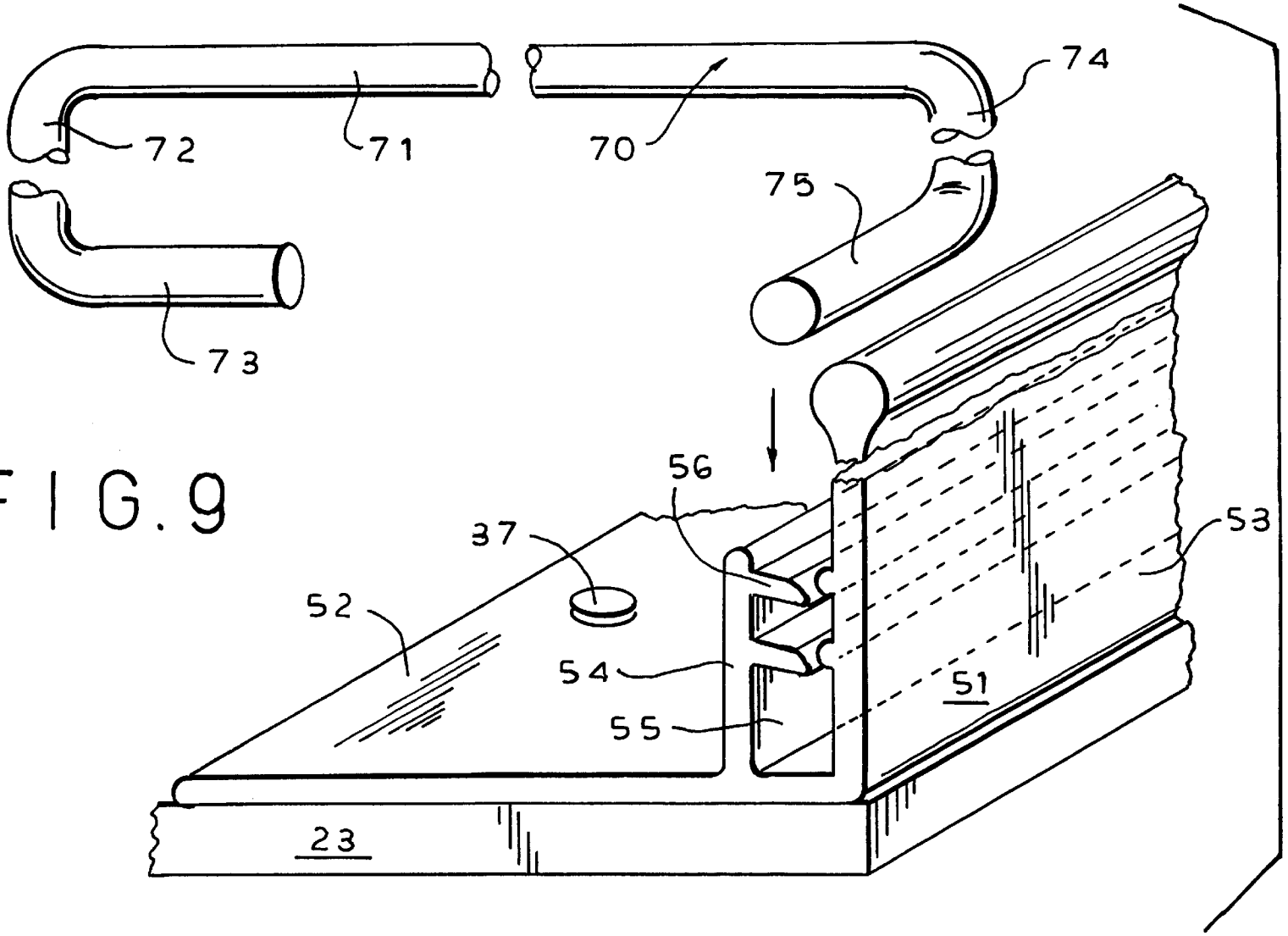
FIG. 9 is a fragmentary perspective view of a still further modified form of the invention, in which the dividing elements are formed of wire, and an integral portion of the wire is used for retention of the divider in the front rail member.
Figure 10:
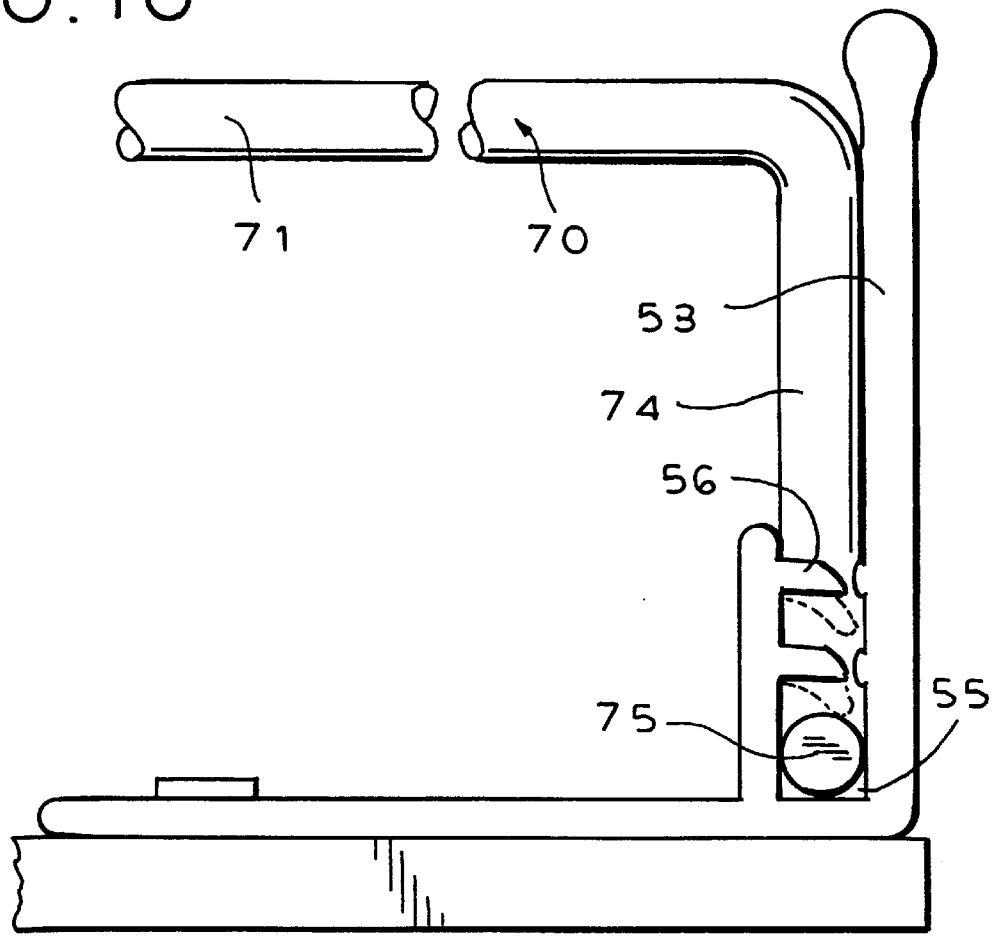
FIG. 10 is a fragmentary end elevational view of the system of FIG. 9, showing the wire divider element in its installed position.
Figure 11:
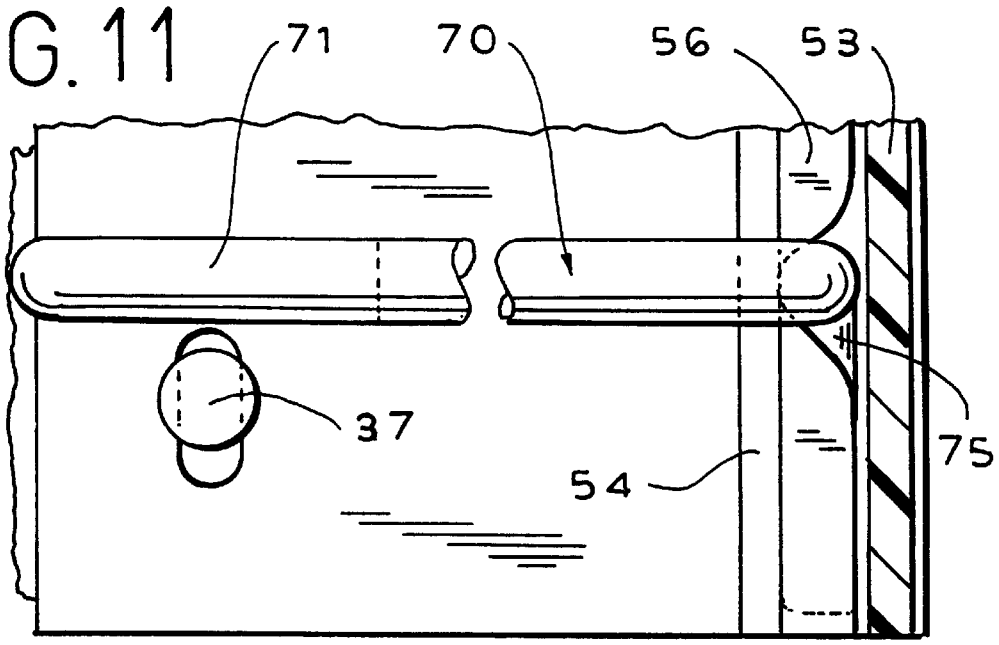
FIG. 11 is a fragmentary top plan view of the system of FIG. 9, with the wire divider element in its installed position.

A still further modification of the invention is shown in FIGS. 9–11, utilizing a front rail element 51 of the type shown in FIGS. 7 and 8, provided with a vertical retention channel 55. In the embodiment of FIGS. 9–11, a wire divider element 70 is constructed with a horizontally extending divider section 71, a vertical leg 72 and a support portion 73 at the back. At the front, the divider element 70 is provided with a downwardly extending leg 74, which extends the full height of the divider and joins integrally at the bottom with a horizontally extending portion 75, which serves the dual purpose of a front support and as a retention element. To install the divider element 70, the divider is positioned laterally as desired, and then the retention element 75 is forced downwardly into the retention channel 55, to a position as shown in FIG. 10. The retaining element 75 is pressed beyond the flexible retaining flanges 56 until it enters the bottom of the retention chamber 55. The front vertical leg 74 of the divider is tightly gripped by the deflected retaining flanges 56, as is indicated in FIG. 11, so that the divider is tightly held in its adjusted position.

Figure 13:
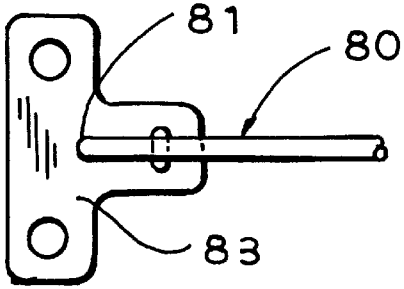
FIG. 13 is a fragmentary top plan view of the divider element of FIG. 12.
Figure 12:
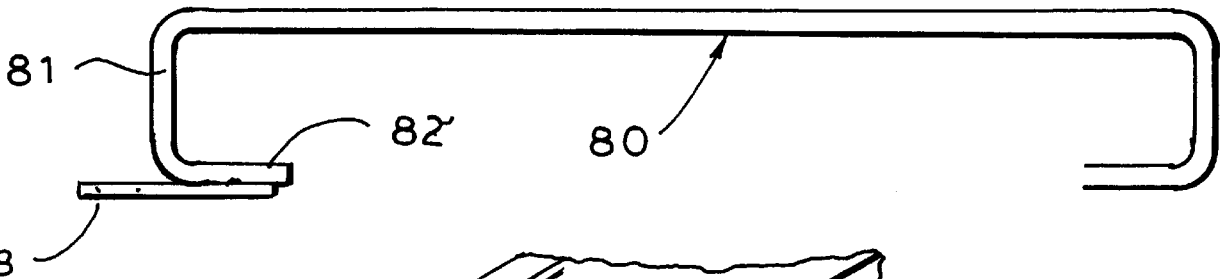
FIG. 12 is a further modified form of wire divider element provided with a metal tongue plate arranged for horizontal insertion.

As will be understood, a wire divider element of the general type described in FIGS. 7 and 8 can be modified for use in combination with a front rail element of the type shown in FIGS. 1–5, provided with a rearwardly opening, horizontally disposed retention channel 30. Such a modification is shown in FIGS. 12 and 13, where a downwardly extending front element 81 of the wire divider 80 would be extended downward for the full height of the divider, and then bent either forward or (preferably) rearward as at 82 and secured to a horizontally disposed tongue plate 83. The horizontally disposed tongue plate 83 is arranged to be joined with the retention channel by forward movement in the same manner as the extruded plastic divider elements 31.

Figures 14, 15, 16, 17:
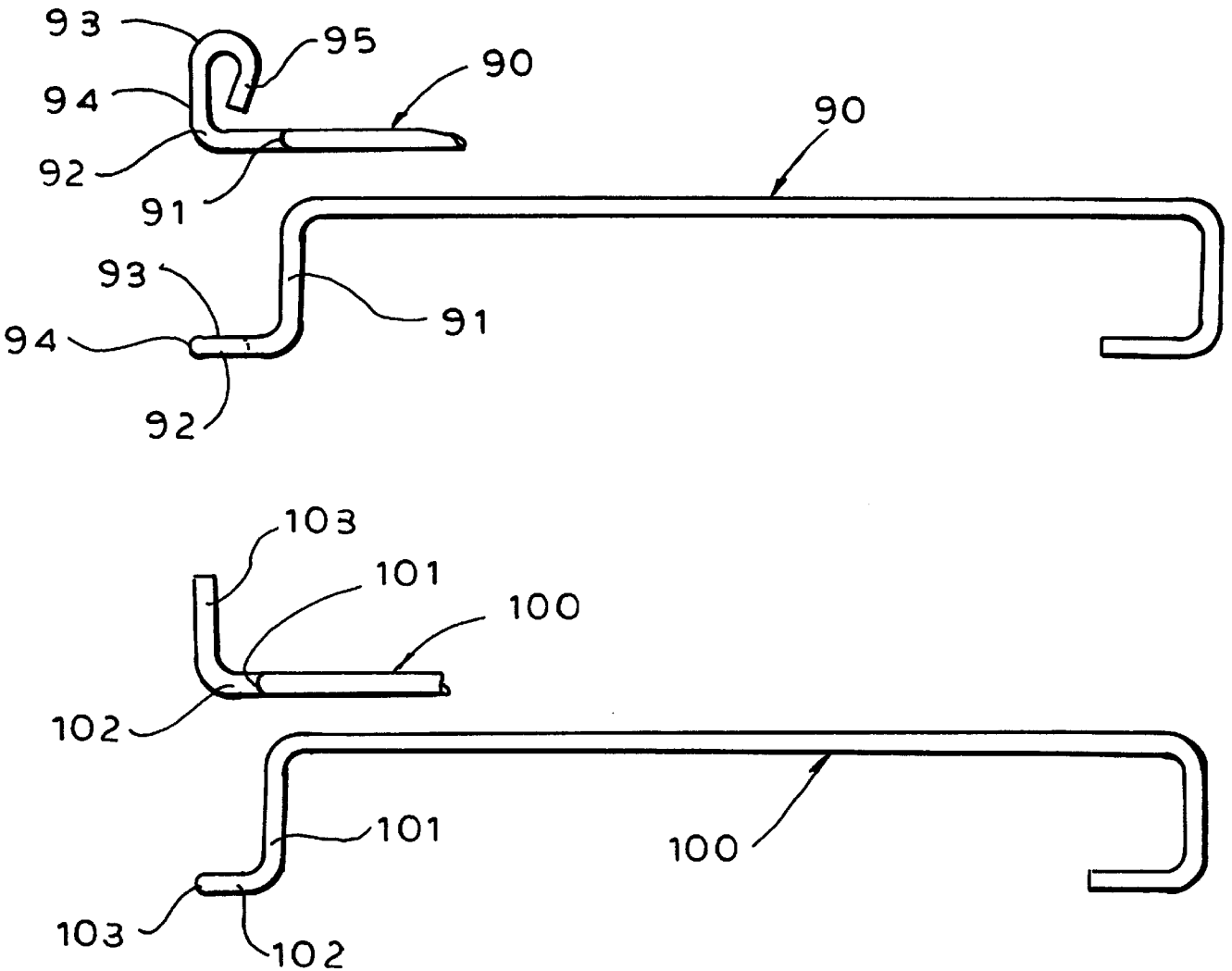
FIG. 14 is a side elevational view of a modified form of wire divider element intended for insertion in a horizontally oriented retention channel.
FIG. 15 is a fragmentary top plan view of the divider element of FIG. 14.
FIG. 16 is a highly simplified form of wire divider element intended for horizontal insertion.
FIG. 17 is a fragmentary top plan view of the divider element of FIG. 16.

Additional simplified forms of wire divider elements are illustrated in FIGS. 14–17. In the modification of FIGS. 14, 15, a wire divider element 90, designed for horizontal insertion, is provided with a front vertical leg 91 which joins at its bottom with a forwardly extending support element 92. At its forward end, the support element 92 joins with a horizontal stabilizing section 93, which consists of a first portion 94 extending at right angles, and a loop portion 95. The divider element 90 is installed by forward insertion into the retention channel 30, in the same manner as the embodiment of FIGS. 12, 13.

The embodiment of FIGS. 16, 17 is even more simplified than the embodiment of FIGS. 14, 15. In the last mentioned embodiment, a divider 100 has a vertical leg 101 which joins at the bottom with a forwardly extending support portion 102. At its forward extremity, the support portion 102 joins with a horizontally disposed portion 103 disposed at right angles to the principal plane of the divider. The divider element 100 is also installed by forward insertion into the retention channel 30.

Figure 18:
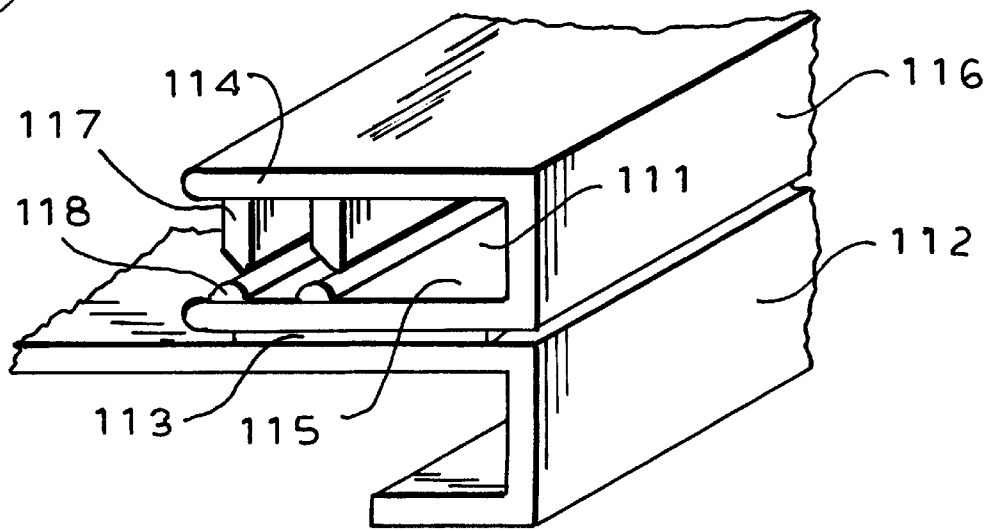
FIG. 18 is a fragmentary perspective view of a modified form of front rail member comprising a rearwardly opening retention channel, utilized without a barrier wall.

For certain purposes, merchandisers may prefer to eliminate a barrier wall at the front, in order to facilitate access to the product displayed on the shelving. For such applications, the system of the invention may advantageously employ a front rail member 110, as shown in FIG. 18, which comprises only a retention channel 111. Thus, in the modification of FIG. 18, the front rail member 110 advantageously is secured to a display shelf 112 by means of an adhesive strip 113 extending along the length of the rail member 110. The rail member comprises upper and lower rearwardly extending flanges 114, 115 and a short vertical front wall 116 joining the two in spaced relation. The rail member 110 advantageously may be extruded of opaque polyvinyl plastic, colored appropriately to blend with the shelving 112, and is provided internally with retaining flanges 117, co-extruded of a soft flexible material, and cooperating with co-extruded ribs 118, also formed of resilient material.

Various of the described forms of divider elements may be installed in the front rail member 110 by forward insertion in the manner previously described to provide shelving which is divided laterally, yet substantially open at the front for easy access. Product items are, at the same time, prevented from accidentally falling off the forward edge of the shelf, by reason of the short barrier provided by the retention channel itself.

The embodiments of FIGS. 9–10 and 14–17 are very economical to manufacture, because they involve only simple operations of bending and cutting of wire which can be highly automated.

In any of its various forms, the shelf management system of the invention has important advantages over systems currently in use. It is far more economical to produce than systems now utilized. At the same time, the new system provides exceptional ease and flexibility of use in setting up organized shelving arrangements. The divider elements, whether of extruded plastic or metal, can be easily and quickly moved to desired lateral positions, for example, by simply pressing the elements laterally against a line of product items. The elements may then be installed by pressing forwardly or downwardly, as the case may be, to insert the divider elements into the continuous retention channel provided by the front rail.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A shelf organizing system for use in combination with generally flat merchandise display shelving having a top surface and a front edge region, which comprises, (a) a front rail member, extruded from relatively rigid plastic material, fixed to the top surface of the display shelving and extending longitudinally along the front edge region thereof to provide a barrier against outward movement of merchandise from said shelving, (b) said front rail member having an upwardly extending confining wall adjacent said front edge region and a generally horizontal base wall joined to a lower portion of said front rail member and extending rearwardly over and being supported by said shelving top surface, (c) a first channel-forming wall integral with said front rail member and extending in spaced parallel relation to a second channel-forming wall formed by one of said confining wall or base wall and defining therewith a narrow open-sided longitudinally extending retention channel for engagement of a lateral divider element, (d) a lateral divider element, separate from said front rail member and having an engagement portion insertable into said open-sided retention channel in a direction perpendicular to a longitudinal axis of said front rail member, (e) said engagement portion being of a size and shape to be firmly gripped in said retention channel, (f) one of said engagement portion and retention channel being formed with integrally co-extruded gripping elements of resilient material for frictional gripping engagement of the said divider element with said front rail member, and (g) said lateral divider element being formed to a desired length suitable for front-to-back dimensions of said shelving.

2. A shelf organizing system according to claim 1, wherein (a) said first channel-forming wall extends parallel to and is spaced above said base wall, (b) said first channel-forming wall and said base wall defining a horizontally disposed, rearwardly opening retention channel, and (c) said lateral divider element having a flat, horizontally disposed, forwardly extending engagement portion received in and gripped on top and bottom surfaces thereof by said retention channel.

3. A shelf organizing system according to claim 2, wherein (a) said lateral divider element comprises an extruded section of relatively rigid plastic material configured to form a generally horizontal stabilizing flange supported by said shelving top surface and a generally vertically extending dividing wall integral with said stabilizing flange, and (b) a forward portion of said stabilizing flange forms said engagement portion and extends into and is gripped by a portion of said open-sided retention channel.

4. A shelf organizing system according to claim 3, wherein said vertically extending dividing wall is formed with a forwardly opening notch at a forward end thereof, above said engagement portion for the reception of said first channel-forming wall.

5. A shelf organizing system according to claim 4, wherein said vertical dividing wall is formed with a rearwardly opening recess at a rearward end thereof, to accommodate assembly of either end of said lateral divider element with said front rail member.

6. A shelf organizing system according to claim 1, wherein (a) at least one gripping and retaining flange is co-extruded of flexible plastic material, integral with one of said channel-forming walls, and extends toward the other of the channel forming walls, and (b) said gripping and retaining flange is resiliently deformed by insertion of said engagement portion into said retention channel.

7. A shelf organizing system according to claim 1, wherein lower portions of said front rail member, including said retention channel, are formed of opaque plastic material.

8. A shelf organizing system according to claim 7, wherein (a) said lateral divider element is formed of extruded plastic material, and (b) lower portions of said divider elements are formed of opaque material.

9. A shelf organizing system for use in combination with generally flat merchandise display shelving having a top surface and a front edge region, which comprises, (a) a front rail member, extruded from relatively rigid plastic material, fixed to the top surface of the display shelving and extending longitudinally along the front edge region thereof to provide a barrier against outward movement of merchandise from said shelving, (b) said front rail member having a generally horizontal base wall extending rearwardly over and being supported by said shelving top surface, (c) a first channel-forming wall integrally joined with said base wall and extending above and in spaced relation thereto and defining with said base wall a narrow rearwardly opening retention channel for engagement of a lateral divider element, (d) a lateral divider element, separate from said front rail member and having a flat, horizontally disposed engagement portion insertable into said rearwardly opening retention channel in a direction perpendicular to a longitudinal axis thereof, (e) said engagement portion being of a size and shape to be firmly gripped in said channel, (f) said lateral divider element being formed to a desired length suitable for front-to-back dimensions of said shelving, (g) at least one gripping and retaining flange being co-extruded of flexible plastic material, integral with one of the walls defining said retention channel and extending toward the other wall defining said retention channel, (h) said gripping and retaining flange being resiliently deformed by insertion of said engagement portion into said retention channel and serving to frictionally grip said engagement portion.

10. A shelf organizing system according to claim 9, wherein (a) said lateral divider element comprises an extruded section of relatively rigid plastic material configured to form a generally horizontal stabilizing flange supported by said shelving top surface and a generally vertically extending dividing wall integral with said stabilizing flange, and (b) a forward portion of said stabilizing flange forms said engagement portion and extends into and is frictionally gripped in said rearwardly opening retention channel by said gripping and retaining flange.

11. A shelf organizing system according to claim 10, wherein portions of said front rail member forming said retention channel are formed of opaque plastic material.

12. A shelf organizing system according to claim 11, wherein (a) said front rail member includes a vertically extending barrier wall projecting above said retention channel, and (b) said barrier wall is formed in substantial part of transparent plastic material.

13. A shelf organizing system for use in combination with generally flat merchandise display shelving having a top surface and a front edge region, which comprises, (a) a front rail member, extruded from relatively rigid plastic material, fixed to the top surface of the display shelving and extending longitudinally along the front edge region thereof to provide a barrier against outward movement of merchandise from said shelving, (b) said front rail member having an upwardly extending confining wall adjacent said front edge region and a generally horizontal base wall joined to a lower portion of said front rail member and extending rearwardly over and being supported by said shelving top surface, (c) a first channel-forming wall integral with said front rail member and extending in spaced parallel relation to a second channel-forming wall formed by one of said confining wall or base wall and defining therewith a narrow open-sided retention channel for engagement of a lateral divider element, (d) a lateral divider element, separate from said front rail member and having an engagement portion insertable into said open-sided retention channel, (e) said engagement portion being of a size and shape to be firmly gripped in said channel, (f) said lateral divider element being formed to a desired length suitable for front-to-back dimensions of said shelving, (g) said first channel-forming wall extending parallel to and being spaced above said base wall, (h) said first channel-forming wall and said base wall defining a horizontally disposed, rearwardly opening retention channel, (i) said lateral divider element having a horizontally forwardly extending engagement portion received in and gripped by said retention channel, (j) said lateral divider element comprising an extruded section of relatively rigid plastic material configured to form a generally horizontal stabilizing flange supported by said shelving top surface and a generally vertically extending dividing wall integral with said stabilizing flange, (k) a forward portion of said stabilizing flange extending into and being gripped by a portion of said open-sided retention channel, and (l) a forward portion of said dividing wall being formed with a forwardly opening slot immediately above said stabilizing flange for the reception of a portion of said first channe-forming wall.

14. A shelf organizing system according to claim 13, wherein (a) said first channel-forming wall is provided on an upper surface thereof with a longitudinally extending retaining rib, and (b) said forwardly opening slot in said dividing wall is formed with a recess in an upper side thereof positioned for snug reception of a portion of said longitudinally extending retaining rib.

15. A shelf organizing system for use in combination with generally flat merchandise display shelving having a top surface and a front edge region, which comprises, (a) a front rail member, extruded from relatively rigid plastic material, fixed to the top surface of the display shelving and extending longitudinally along the front edge region thereof to provide a barrier against outward movement of merchandise from said shelving, (b) said front rail member having an upwardly extending confining wall adjacent said front edge region and a generally horizontal base wall joined to a lower portion of said front rail member and extending rearwardly over and being supported by said shelving top surface, (c) a first channel-forming wall integral with said front rail member and extending in spaced parallel relation to a second channel-forming wall formed by one of said confining wall or base wall and defining therewith a narrow open-sided retention channel for engagement of a lateral divider element, (d) a lateral divider element, separate from said front rail member and having an engagement portion insertable into said open-sided retention channel, (e) said engagement portion being of a size and shape to be firmly gripped in said channel, (f) said lateral divider element being formed to a desired length suitable for front-to-back dimensions of said shelving, (g) said first channel-forming wall extending parallel to and being spaced above said base wall, (h) said first channel-forming wall and said base wall defining a horizontally disposed, rearwardly opening retention channel, (i) said lateral divider element having a horizontally forwardly extending engagement portion received in and gripped by said retention channel, (j) said lateral divider element comprising an extruded section of relatively rigid plastic material configured to form a generally horizontal stabilizing flange supported by said shelving top surface and a generally vertically extending dividing wall integral with said stabilizing flange, (k) a forward portion of said stabilizing flange extending into and being gripped by a portion of said open-sided retention channel, (l) said vertically extending dividing wall being formed with a forwardly opening notch at a forward end thereof for the reception of said first channel-forming wall, (m) said first channel-forming wall being formed with a continuously extending detent rib along an upper surface thereof, and (n) said forwardly opening notch being formed with a detent recess therein for reception of a portion of said detent rib.

* * * * *